US009865978B2

(12) United States Patent
Hashiguchi

(10) Patent No.: US 9,865,978 B2
(45) Date of Patent: Jan. 9, 2018

(54) IDENTICAL MEZZANINE CONNECTORS

(71) Applicant: JAPAN AVIATION ELECTRONICS INDUSTRY, LIMITED, Shibuya-ku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/063,321

(22) Filed: Mar. 7, 2016

(65) Prior Publication Data

US 2016/0315432 A1 Oct. 27, 2016

(30) Foreign Application Priority Data

Apr. 21, 2015 (JP) ..... 2015-086424

(51) Int. Cl.
*H01R 13/28* (2006.01)
*H01R 24/84* (2011.01)
*H01R 13/631* (2006.01)

(52) U.S. Cl.
CPC ..... *H01R 24/84* (2013.01); *H01R 13/631* (2013.01); *H01R 13/28* (2013.01)

(58) Field of Classification Search
CPC .. H01R 12/7005; H01R 24/84; H01R 13/514; H01R 23/27
USPC ..... 439/291, 284, 74
See application file for complete search history.

(56) References Cited

U.S. PATENT DOCUMENTS 6,926,538 B2 * 8/2005 Ma ..... H01R 13/26 439/74
7,179,108 B2 2/2007 Goodman et al.
7,371,096 B2 5/2008 Goodman et al.
9,118,157 B2 8/2015 Miyaki
9,543,703 B2 * 1/2017 Horchler ..... H01R 13/64

FOREIGN PATENT DOCUMENTS

JP 2008512842 A 4/2008
JP 2009187679 A 8/2009
JP 2014191882 A 10/2014

* cited by examiner

*Primary Examiner* — Vanessa Girardi
(74) *Attorney, Agent, or Firm* — Holtz, Holtz & Volek PC

(57) ABSTRACT

A connector is mateable with a mating connector along a first direction. The mating connector comprises a plurality of mating protrusions. Each of the mating protrusions protrudes along the first direction. The mating protrusions include a first mating protrusion and a second mating protrusion. The connector comprises a terminal and a holding member. The holding member is provided with a plurality of receiving portions. The receiving portions include a first receiving portion and a second receiving portion. The first receiving portion is opened in each of the first direction and a second direction which is perpendicular to the first direction. When the connector is mated with the mating connector, the first receiving portion receives the first mating protrusion to regulate a movement of the first mating protrusion. The second receiving portion is opened in each of the first direction and a third direction. When the connector is mated with the mating connector, the second receiving portion receives the second mating protrusion to regulate a movement of the second mating protrusion.

4 Claims, 5 Drawing Sheets

IDENTICAL MEZZANINE CONNECTORS

CROSS REFERENCE TO RELATED APPLICATIONS

An applicant claims priority under 35 U.S.C. §119 of Japanese Patent Application No. JP2015-086424 filed Apr. 21, 2015.

BACKGROUND OF THE INVENTION

This invention relates to a connector assembly which comprises a connector and a mating connector and which further comprises a guide mechanism for guiding the connector and the mating connector to be mated with each other.

For example, JP-A 2008-512842 (Patent Document 1) discloses a connector assembly of this type. As shown in FIG. 9, the connector assembly 900 of Patent Document 1 comprises a connector 910 and a mating connector 950. The connector 910 and the mating connector 950 have structures same as each other. In other words, each of the connector 910 and the mating connector 950 is hermaphrodite.

Each of the connector 910 and the mating connector 950 comprises terminals 920, a holding member 930 and a guide pin 940. The holding member 930 holds the terminals 920 and the guide pin 940. The holding member 930 is formed with a guide hole 935. When the connector 910 is mated with the mating connector 950, the guide pin 940 of the connector 910 is received into the guide hole 935 of the mating connector 950 to guide the connector 910 to be mated with the mating connector 950. As described above, the connector assembly 900 of Patent Document 1 is provided with a guide mechanism.

SUMMARY OF THE INVENTION

It is an object of the present invention to provide a connector assembly which comprises a guide mechanism and which has a reduced size, and to provide a connector constituting the connector assembly.

One aspect of the present invention provides a connector mateable with a mating connector along a first direction. The mating connector comprises a plurality of mating protrusions. Each of the mating protrusions protrudes along the first direction. The mating protrusions include a first mating protrusion and a second mating protrusion. The connector comprises a terminal and a holding member which holds the terminal. The holding member is provided with a plurality of receiving portions. The receiving portions include a first receiving portion and a second receiving portion. The first receiving portion is opened in each of the first direction and a second direction which is perpendicular to the first direction. When the connector is mated with the mating connector, the first receiving portion receives the first mating protrusion to regulate a movement of the first mating protrusion. The second receiving portion is opened in each of the first direction and a third direction. The third direction is perpendicular to the first direction and is different from the second direction. When the connector is mated with the mating connector, the second receiving portion receives the second mating protrusion to regulate a movement of the second mating protrusion.

Another aspect of the present invention provides a connector assembly comprising the connector and the mating connector.

The mating connector comprises the mating protrusions each of which corresponds to the guide pin of Patent Document 1, and the connector comprises the receiving portions each of which corresponds to the guide hole of Patent Document 1. Although the guide hole of Patent Document 1 pierces the holding member of Patent Document 1 along a mating direction which corresponds to the first direction of the present invention, the guide hole of Patent Document 1 does not communicate with an outside of the holding member of Patent Document 1 in a direction perpendicular to the mating direction which corresponds to the first direction of the present invention. In other words, the guide hole of Patent Document 1 has a closed circumference in a plane perpendicular to the mating direction which corresponds to the first direction of the present invention. In contrast, each of the receiving portions of the connector is opened also in a direction perpendicular to the first direction. Specifically, each of the receiving portions does not have a closed circumference in a plane perpendicular to the first direction. Accordingly, the connector does not require portions which are needed for surrounding the receiving portions, respectively, so that the holding member can have a reduced size. Thus, the connector can be reduced in size so that the connector assembly can be reduced in size.

The mating connector has two kinds of the mating protrusions, i.e. the first mating protrusion and the second mating protrusion, and the connector has two kinds of the receiving portions, i.e. the first receiving portion and the second receiving portion. The first receiving portion is opened in each of the second direction and the first direction. When the connector is mated with the mating connector, the first receiving portion receives the first mating protrusion to regulate the movement of the first mating protrusion. The second receiving portion is opened in each of the third direction and the first direction. When the connector is mated with the mating connector, the second receiving portion receives the second mating protrusion to regulate the movement of the second mating protrusion. Meanwhile, each of the second direction and the third direction is perpendicular to the first direction, and the second direction and the third direction are different from each other. Accordingly, the regulation of the first mating protrusion by the first receiving portion and the regulation of the second mating protrusion by the second receiving portion complement each other. Thus, a set of the first receiving portion, the first mating protrusion, the second receiving portion and the second mating protrusion can appropriately guide the mating of the connector with the mating connector while the holding member has a reduced size so that the connector assembly is reduced in size as described above.

Figure 1:
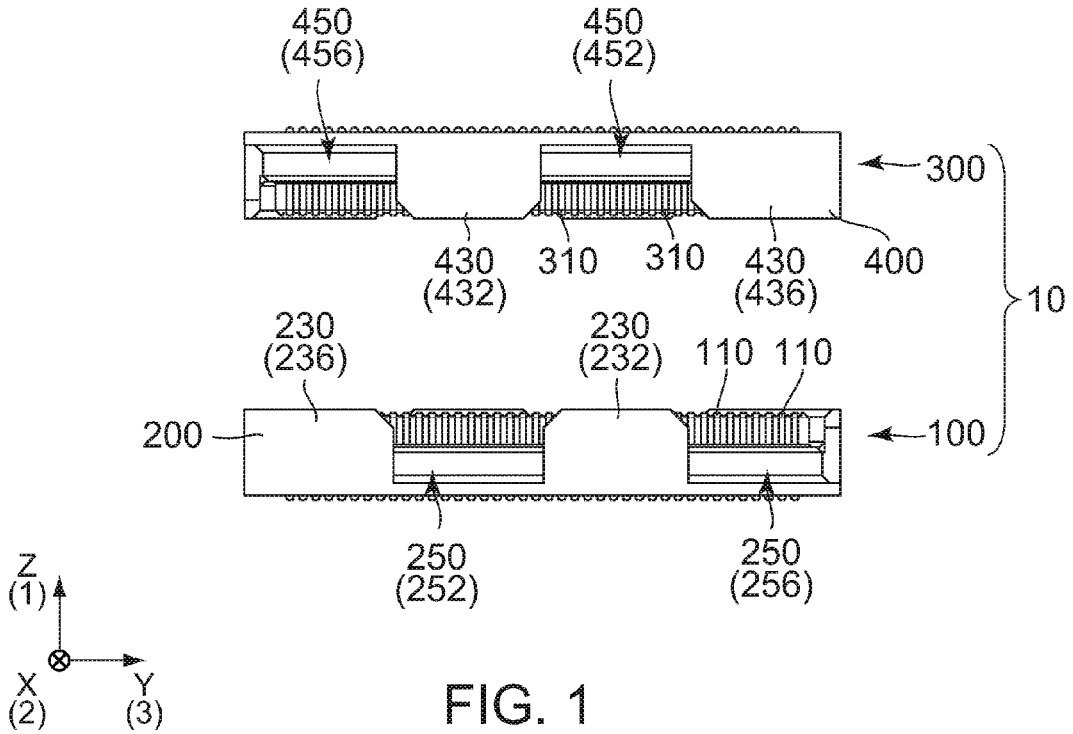
FIG. 1 is a side view showing a connector assembly which comprises a connector and a mating connector according to an embodiment of the present invention. The connector and the mating connector are not yet mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 4, a connector assembly 10 according to an embodiment of the present invention comprises a connector 100 and a mating connector 300 which are mateable with each other along a first direction. In the present embodiment, the first direction is a Z-direction. The connector 100 and the mating connector 300 of the present embodiment have shapes same as each other. In other words, each of the connector 100 and the mating connector 300 is hermaphrodite.

Figure 5:
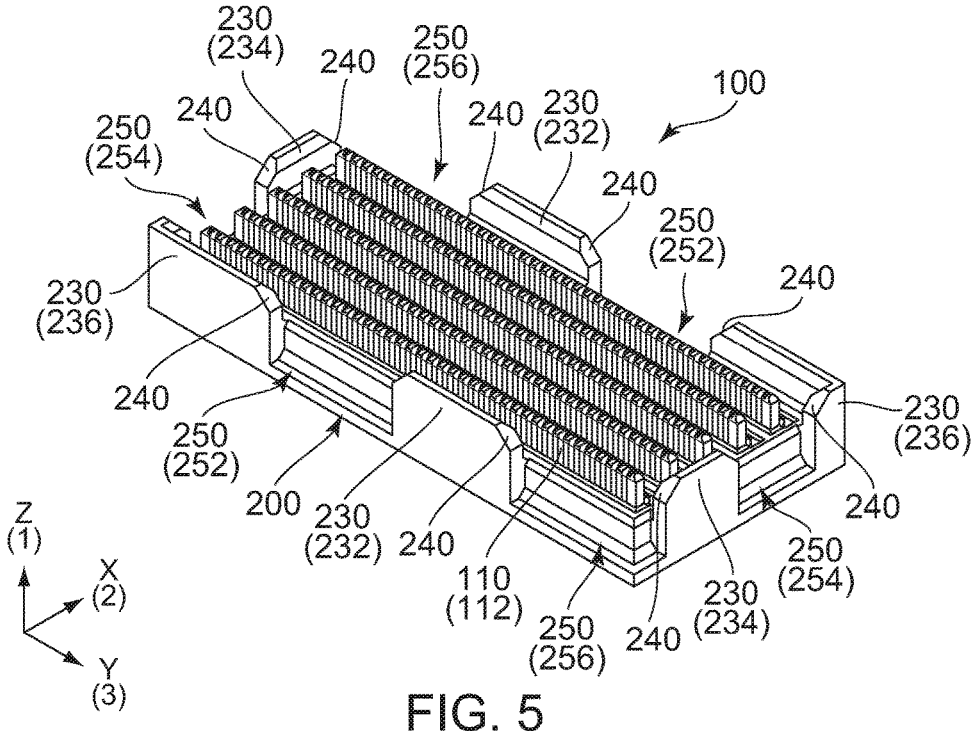
FIG. 5 is a perspective view showing the connector of FIG. 1.
Figure 8:
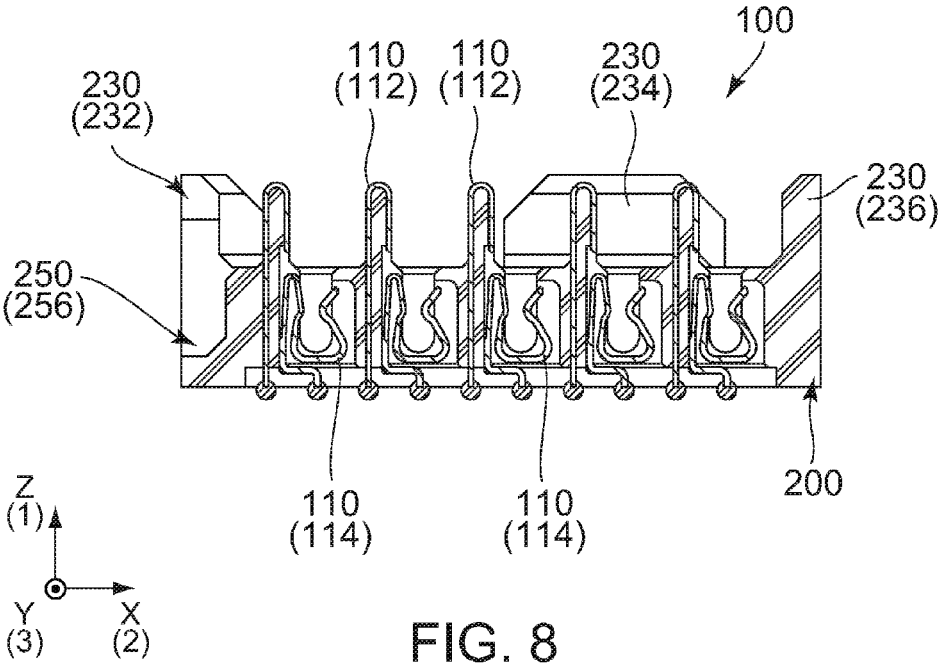
FIG. 8 is a cross-sectional view showing the connector of FIG. 6, taken along line B-B.

Referring to FIGS. 5 and 8, the connector 100 of the present embodiment comprises terminals 110 and a holding member 200. Specifically, each of the terminals 110 is made of conductor, and the holding member 200 is made of insulator. As shown in FIG. 8, each of the terminals 110 of the present embodiment includes a male terminal member 112 and a female terminal member 114.

Figure 6:
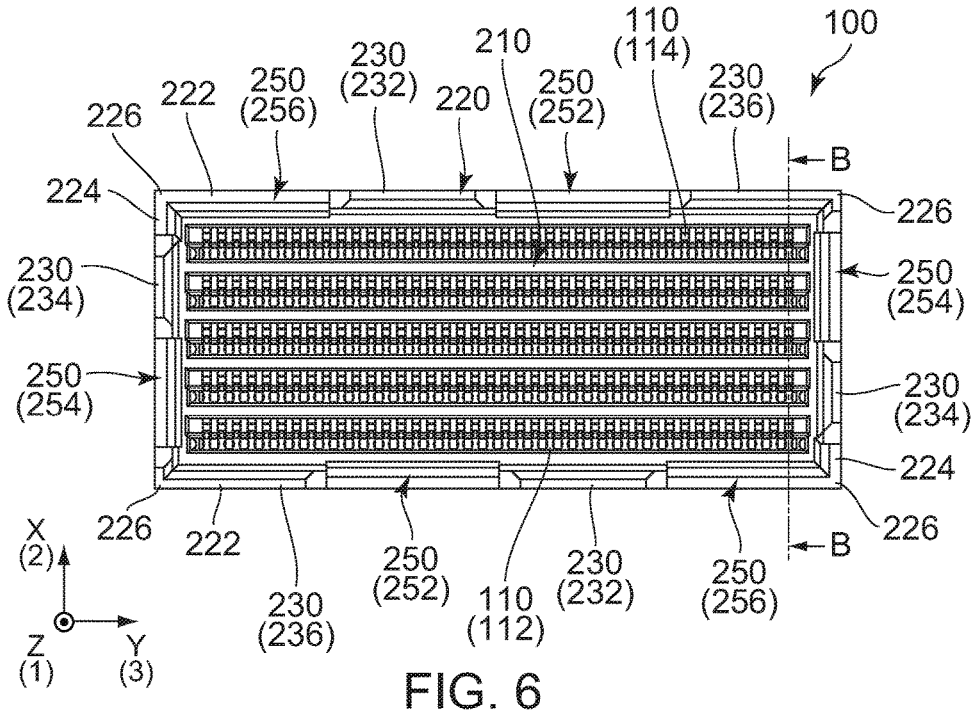
FIG. 6 is a top view showing the connector of FIG. 5.

As shown in FIG. 6, the holding member 200 has a holding portion 210 and an outer circumference 220. The holding portion 210 holds the terminals 110. In other words, the holding member 200 holds the terminals 110. The outer circumference 220 is positioned outward of the holding portion 210. In particular, in the present embodiment, the outer circumference 220 is positioned at the outermost position of the holding member 200. As understood from FIG. 6, when the holding member 200 is seen along the first direction, the holding member 200 has a rectangular shape which has two longer sides 222 and two shorter sides 224. Each of the shorter sides 224 of the present embodiment extends in a second direction. In addition, each of the longer sides 222 of the present embodiment extends in a third direction. In the present embodiment, the second direction is an X-direction, and the third direction is a Y-direction. Specifically, each of the second direction and the third direction is perpendicular to the first direction. Furthermore, in the present embodiment, the second direction is perpendicular to the third direction. In the present embodiment, each of the longer sides 222 and each of the shorter sides 224 are coupled with each other by a corner portion 226. The total number of the corner portions 226 is four.

As shown in FIG. 5, the outer circumference 220 of the holding member 200 is provided with a plurality of protrusions 230 and a plurality of receiving portions 250. Specifically, each of the protrusions 230 protrudes along the first direction, and each of the receiving portions 250 is recessed along the first direction. The protrusions 230 include two first protrusions 232, two second protrusions 234 and two third protrusions 236. The receiving portions 250 include two first receiving portions 252, two second receiving portions 254 and two third receiving portions 256.

As shown in FIG. 6, the first protrusions 232 are formed on the longer sides 222 of the outer circumference 220, respectively, and the second protrusions 234 are formed on the shorter sides 224 of the outer circumference 220, respectively. The third protrusions 236 are formed on two of the corner portions 226, respectively, wherein the two of the corner portions 226 are positioned on two opposite corners of the outer circumference 220, respectively. The third protrusions 236 correspond to the longer sides 222 and the shorter sides 224, respectively. Specifically, each of the third protrusions 236 includes a corresponding one of the two of the corner portions 226 and has a first part, which is positioned on the corresponding longer side 222, and a second part which is positioned on the corresponding shorter side 224. Similarly, the first receiving portions 252 are formed on the longer sides 222, respectively, and the second receiving portions 254 are formed on the shorter sides 224, respectively. The third receiving portions 256 are formed on the remaining two of the corner portions 226, respectively, wherein the remaining two of the corner portions 226 are positioned on the remaining two opposite corners of the outer circumference 220, respectively. The third receiving portions 256 correspond to the longer sides 222 and the shorter sides 224, respectively. Specifically, each of the third receiving portions 256 includes a corresponding one of the remaining two of the corner portions 226 and has a first portion, which is positioned on the corresponding longer side 222, and a second portion which is positioned on the corresponding shorter side 224. In detail, the first protrusions 232 are positioned between the first receiving portions 252 and the third receiving portions 256, respectively, and the second protrusions 234 are positioned between the third receiving portions 256 and the second receiving portions 254, respectively. In addition, the third protrusions 236 are positioned between the second receiving portions 254 and the first receiving portions 252, respectively. In other words, each of the protrusions 230 is positioned between two of the receiving portions 250 each of which is closest thereto among the receiving portions 250.

Figure 7:
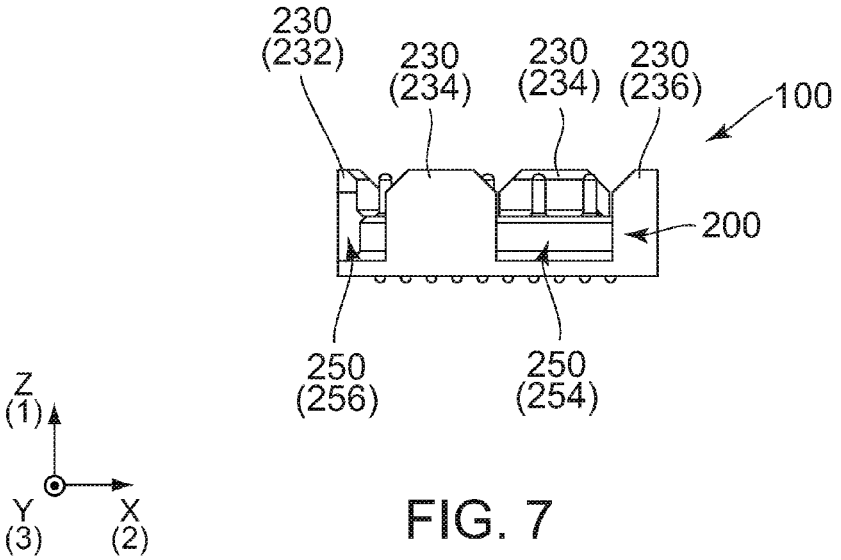
FIG. 7 is a front view showing the connector of FIG. 5.

As understood from FIGS. 1, 5 and 7, each of the protrusions 230 of the present embodiment consists of only a plate-like portion or only a combination of plate-like portions. In detail, each of the first protrusions 232 consists only of a plate-like portion extending in a plane which is defined by the first direction and the third direction. Each of the second protrusions 234 consists only of a plate-like portion extending in a plane which is defined by the first direction and the second direction. Each of the third protrusions 236 consists of only a combination of a plate-like portion, which extends in a plane defined by the first direction and the third direction, and another plate-like portion which extends in a plane defined by the first direction and the second direction. Specifically, each of the third protrusions 236 has an L-like cross-section in a plane perpendicular to the first direction. Since each of the protrusions 230 consists of only a plate-like portion or only a combination of plate-like portions as described above, each of the protrusions 230 can occupy a reduced space in a plane perpendicular to the first direction.

As understood from FIGS. 1, 5 and 7, an end of each of the protrusions 230 is formed with guide portions 240 each of which intersects with the first direction. As understood from FIGS. 5 and 6, each of the third protrusions 236 has the guide portion 240, which is positioned on the longer side 222, and the guide portion 240 which is positioned on the shorter side 224. If the third protrusion 236 consists only of a plate-like portion which is positioned on the longer side 222, the guide portion 240 of the third protrusion 236 which is positioned on the shorter side 224 cannot have a sufficient size. In contrast, since each of the third protrusions 236 of the present embodiment includes the corner portion 226 and is arranged so as to partially extend on the longer side 222 and the shorter side 224, the guide portion 240 of each of the third protrusions 236 which is positioned on the shorter side 224 can have a sufficient size.

Figure 9:
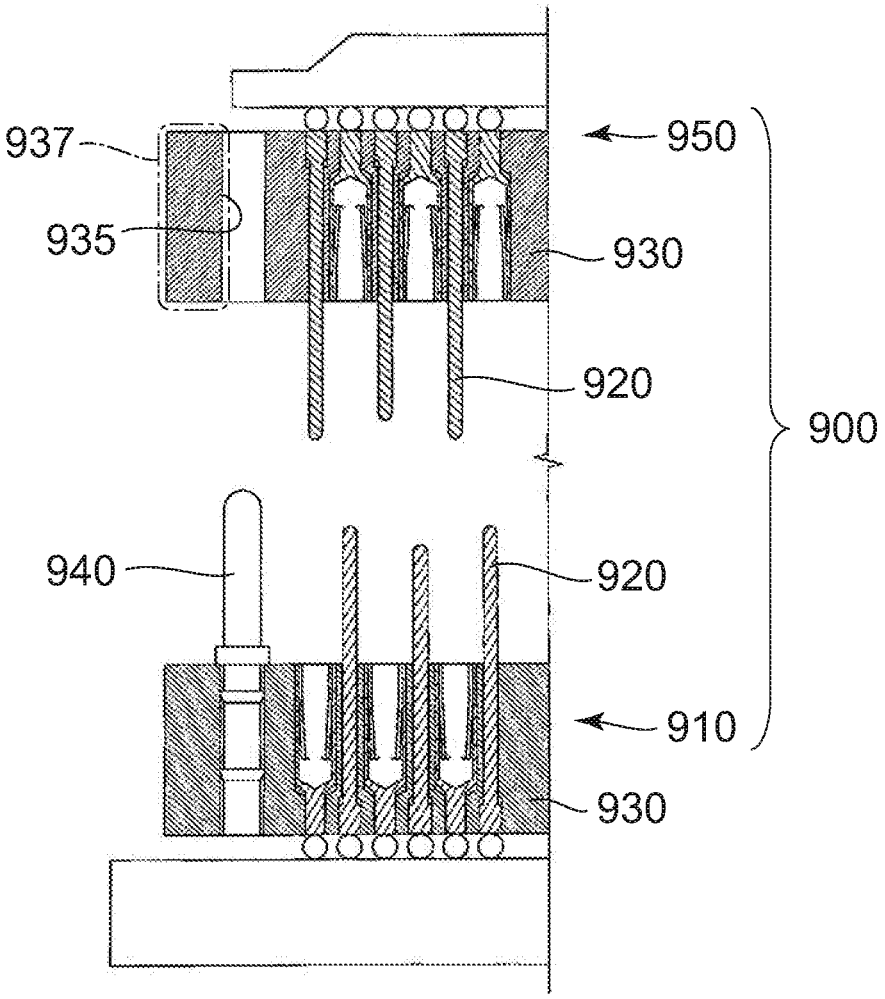
FIG. 9 PRIOR ART
FIG. 9 is a view showing a connector of Patent Document 1.

As shown in FIG. 5, each of the first receiving portions 252 is opened in each of the first direction and the second direction. Each of the second receiving portions 254 is opened in each of the first direction and the third direction. Each of the third receiving portions 256 is opened in each of the first direction, the second direction and the third direction. As understood from FIGS. 5 and 6, each of the receiving portions 250 of the present embodiment does not have a closed circumference in a plane perpendicular to the first direction. The mating connector 950 of Patent Document 1 which is shown in FIG. 9 is provided with a portion 937 which is used for forming the closed circumference of the guide hole 935. In contrast, in the connector 100 of the present embodiment which is shown in FIGS. 5 and 6, each of the receiving portions 250 is opened in a plane perpendicular to the first direction. In other words, the connector 100 of the present embodiment has no portion equivalent to the portion 937 of FIG. 9. Thus, according to the present embodiment, the holding member 200 can have a reduced size.

As described above, each of the connector 100 and the mating connector 300 is hermaphrodite as shown in FIG. 1. In other words, the connector 100 and the mating connector 300 have shapes same as each other. In detail, referring to FIGS. 1 to 4, the mating connector 300 comprises mating terminals 310 and a mating holding member 400. Specifically, each of the mating terminals 310 is made of conductor, and the mating holding member 400 is made of insulator. As understood form FIG. 1, each of the mating terminals 310 has a structure same as that of the terminal 110. As shown in FIG. 4, the mating terminal 310 includes a male terminal member 312 and a female terminal member 314. When the connector 100 and the mating connector 300 are mated with each other, the male terminal members 312 are received in the female terminal members 114, respectively, and the female terminal members 314 receive the male terminal members 112, respectively.

Figure 2:
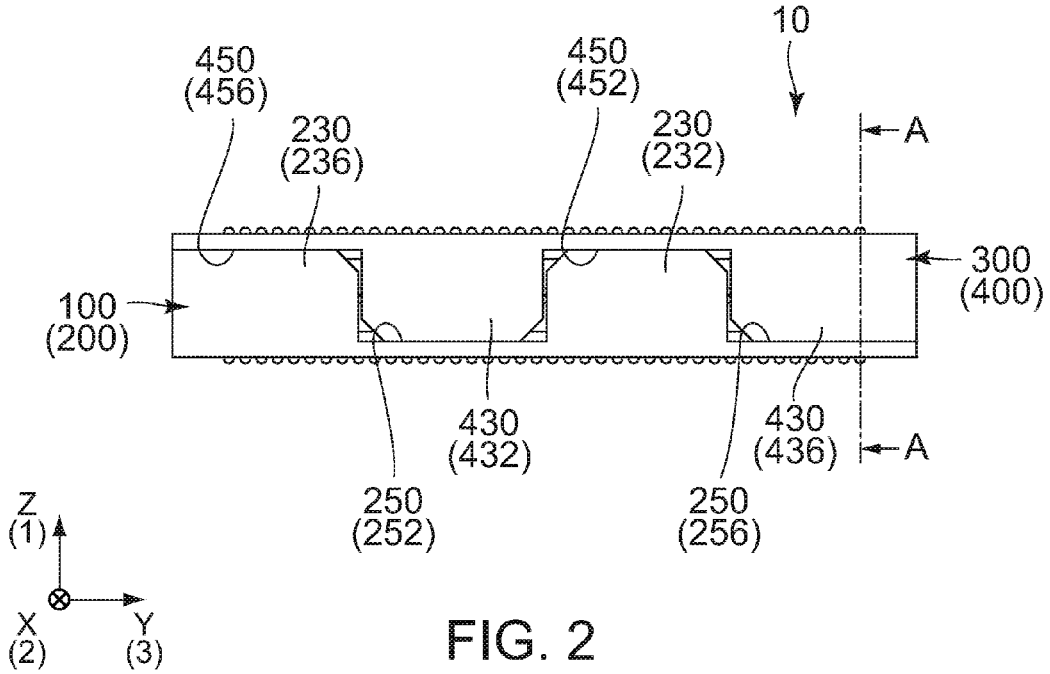
FIG. 2 is another side view showing the connector assembly of FIG. 1. The connector and the mating connector are mated with each other.
Figure 3:
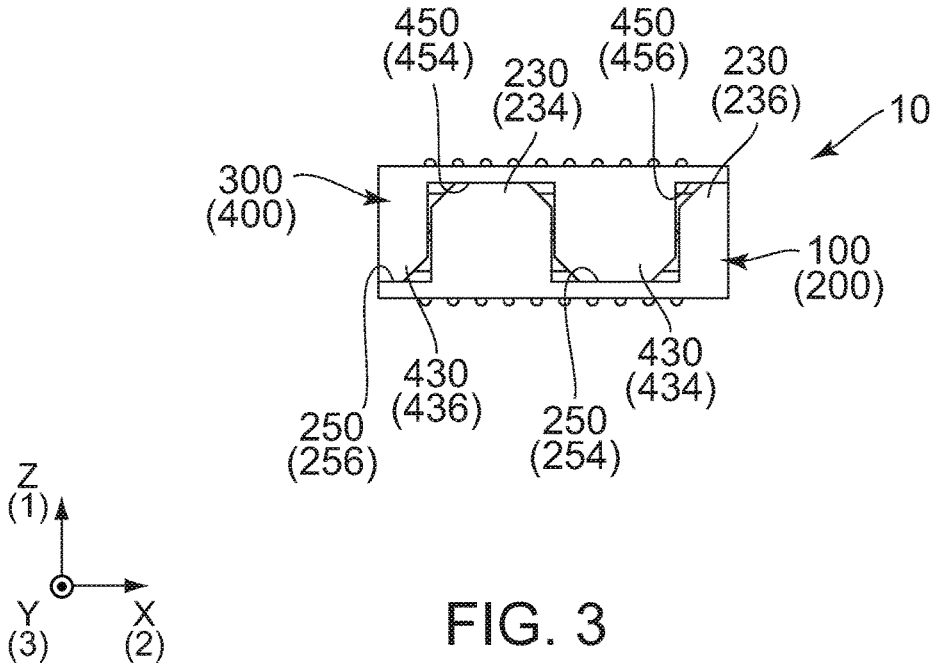
FIG. 3 is a front view showing the connector assembly of FIG. 2.
Figure 4:
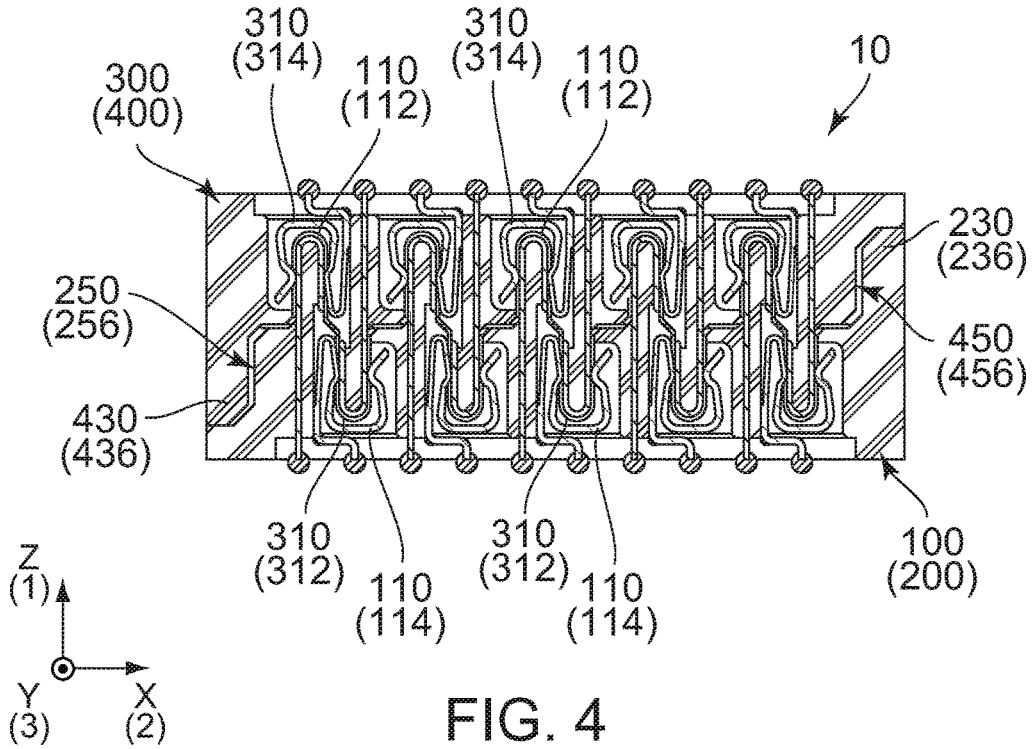
FIG. 4 is a cross-sectional view showing the connector assembly of FIG. 2, taken along line A--A.

As shown in FIGS. 1 to 3, the mating holding member 400 is provided with a plurality of mating protrusions 430 and a plurality of mating receiving portions 450. Specifically, each of the mating protrusions 430 protrudes along the first direction, and each of the mating receiving portions 450 is recessed along the first direction. Each of the mating protrusions 430 has a structure same as that of the protrusion 230. Each of the mating receiving portions 450 has a structure same as that of the receiving portion 250. Each of the mating protrusions 430 is positioned between the mating receiving portions 450. Specifically, the mating protrusions 430 include two first mating protrusion 432, two second mating protrusion 434 and two third mating protrusion 436, wherein the two first mating protrusion 432 correspond to the two first protrusions 232, respectively, the two second mating protrusion 434 correspond to the two second protrusions 234, respectively, and the two third mating protrusion 436 correspond to the two third protrusions 236, respectively. Meanwhile, the mating receiving portions 450 include two first mating receiving portions 452, two second mating receiving portions 454 and two third mating receiving portions 456 which correspond to the first receiving portions 252, the second receiving portions 254 and the third receiving portions 256, respectively.

When the connector 100 is mated with the mating connector 300, the receiving portions 250 receive the mating protrusions 430 to regulate movements of the mating protrusions 430, respectively. Meanwhile, when the connector 100 is mated with the mating connector 300, the protrusions 230 are received in the mating receiving portions 450, respectively, so that a movement of each of the protrusions 230 is regulated by the corresponding mating receiving portion 450.

More specifically, when the connector 100 is mated with the mating connector 300, the first protrusions 232 are received in the first mating receiving portions 452, respectively, the second protrusions 234 are received in the second mating receiving portions 454, respectively, and the third protrusions 236 are received in the third mating receiving portions 456, respectively. Meanwhile, when the connector 100 is mated with the mating connector 300, the first receiving portions 252 receive the first mating protrusions 432, respectively, the second receiving portions 254 receive the second mating protrusions 434, respectively, and the third receiving portions 256 receive the third mating protrusions 436, respectively.

As described above, each of the first receiving portions 252, the second receiving portions 254 and the third receiving portions 256 does not have a closed circumference in a plane perpendicular to the first direction. Similarly, each of the first mating receiving portions 452, the second mating receiving portions 454 and the third mating receiving portions 456 does not have a closed circumference in a plane perpendicular to the first direction. Accordingly, as shown in FIGS. 2 and 3, when the connector 100 is mated with the mating connector 300, each of the first protrusions 232, the second protrusions 234, the third protrusions 236, the first mating protrusions 432, the second mating protrusions 434 and the third mating protrusions 436 is exposed outward in a direction perpendicular to the first direction.

In detail, as understood from FIGS. 1 and 2, when the connector 100 is mated with the mating connector 300, each of the first receiving portions 252 receives the corresponding first mating protrusion 432 to regulate a movement of the corresponding first mating protrusion 432. Specifically, each of the first receiving portions 252 regulates the movement of the corresponding first mating protrusion 432 along the third direction. In other words, each of the first receiving portions 252 regulates the movement of the corresponding first mating protrusion 432 in a direction which is along the outer circumference 220 of the holding member 200 in a plane perpendicular to the first direction.

As understood from FIG. 3, when the connector 100 is mated with the mating connector 300, each of the second receiving portions 254 receives the corresponding second mating protrusion 434 to regulate a movement of the corresponding second mating protrusion 434. Specifically, each of the second receiving portions 254 regulates the movement of the corresponding second mating protrusion 434 along the second direction. In other words, each of the second receiving portions 254 regulates the movement of the corresponding second mating protrusion 434 in a direction which is along the outer circumference 220 of the holding member 200 in a plane perpendicular to the first direction.

Since each of the receiving portions 250 of the present embodiment does not have a closed circumference in a plane perpendicular to the first direction, the holding member 200 can have a reduced size. Meanwhile, each of the first receiving portions 252 cannot regulate an outward movement of the corresponding first mating protrusion 432 in the second direction, and each of the second receiving portions 254 cannot regulate an outward movement of the corresponding second mating protrusion 434 in the third direction. However, the regulation of each of the first mating protrusions 432 by the corresponding first receiving portion 252 and the regulation of each of the second mating protrusions 434 by the corresponding second receiving portion 254 complement each other. Accordingly, when the connector 100 is mated with the mating connector 300, a set of the first receiving portions 252, the first mating protrusions 432, the second receiving portions 254 and the second mating protrusions 434 can appropriately guide the mating of the connector 100 with the mating connector 300.

While the present invention has been described with specific embodiments, the present invention is not limited to the aforementioned embodiments. Various modifications and applications are possible with the present invention.

Although the holding member 200 of the aforementioned embodiment has a rectangular shape when seen along a mating direction, or the first direction, the present invention is not limited thereto. For example, the holding member 200 may have a circular shape when seen along the first direction.

In addition, although the second direction and the third direction of the aforementioned embodiment are perpendicular to each other, the present invention is not limited thereto. The second direction and the third direction may not be perpendicular to each other, provided that each of the second direction and the third direction is perpendicular to the first direction while the second direction and the third direction are different from each other. For example, in a case where the connector 100 has a circular outer shape, the second direction and the third direction may make an angle other than 90 degrees, provided that the second direction is a tangential direction of the circular outer shape while the third direction is another tangential direction thereof.

Although each of the connector 100 and the mating connector 300 of the aforementioned embodiment is hermaphrodite, the present invention is not limited thereto. Each of the connector 100 and the mating connector 300 may not be hermaphrodite. For example, the connector 100 may comprise only the receiving portions 250 among the protrusions 230 and the receiving portions 250 while the mating connector 300 may comprise only the mating protrusions 430 among the mating protrusions 430 and the mating receiving portions 450.

In the aforementioned embodiment, each of the terminals 110 includes the male terminal member 112 and the female terminal member 114, and each of the mating terminals 310 includes the male terminal member 312 and the female terminal member 314. However, the present invention is not limited thereto. The connector assembly 10 may have any of various combinations of terminals and mating terminals.

The present application is based on a Japanese patent application of JP2015-086424 filed before the Japan Patent Office on Apr. 21, 2015, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a first direction, wherein:

the mating connector comprises a plurality of mating protrusions;

each of the mating protrusions protrudes along the first direction;

the mating protrusions include a first mating protrusion, a second mating protrusion, and a third mating protrusion;

the connector comprises a terminal and a holding member which holds the terminal;

the holding member is provided with a plurality of receiving portions;

the receiving portions include a first receiving portion, a second receiving portion, and a third receiving portion;

the first receiving portion is opened in each of the first direction and a second direction which is perpendicular to the first direction;

when the connector is mated with the mating connector, the first receiving portion receives the first mating protrusion to regulate a movement of the first mating protrusion;

the second receiving portion is opened in each of the first direction and a third direction;

the third direction is perpendicular to the first direction and is different from the second direction;

when the connector is mated with the mating connector, the second receiving portion receives the second mating protrusion to regulate a movement of the second mating protrusion;

the second direction and the third direction are perpendicular to each other;

the third receiving portion is opened in each of the first direction, the second direction and the third direction;

when the holding member is seen along the first direction, the holding member has a rectangular shape which has longer sides and shorter sides;

the first receiving portion is formed on one of the longer sides;

the second receiving portion is formed on one of the shorter sides;

the mating connector has mating receiving portions each of which is positioned between the mating protrusions;

the connector has protrusions each of which is positioned between the receiving portions;

when the connector is mated with the mating connector, the protrusions are received in the mating receiving portions, respectively;

each of the protrusions has an end in the first direction;

the holding member has a plurality of corner portions each of which couples one of the longer sides and one of the shorter sides with each other;

at least one of the protrusions includes one of the corner portions and has a first part and a second part, the first part being positioned on one of the longer sides, and the second part being positioned on one of the shorter sides;

the end of each of the protrusions is formed with a guide portion which intersects with the first direction;

each of the protrusions consists of only a plate-like portion or only a combination of plate-like portions;

the holding member has an outer circumference;

the protrusions include two first protrusions, two second protrusions, and two third protrusions;

the first protrusions are formed on the longer sides of the outer circumference, respectively;

the second protrusions are formed on the shorter sides of the outer circumference, respectively;

the third protrusions are formed on two of the corner portions, respectively;

when the connector is mated with mating connector, the third receiving portion receives the third mating protrusion;

the third receiving portion includes one of the corner portions;

the third receiving portion has a first portion and a second portion;

the first portion of the third receiving portion is positioned on one of the longer sides; and the second portion of the third receiving portion is positioned on one of the shorter sides.

2. The connector as recited in claim 1, wherein:

when the connector is mated with the mating connector, the first receiving portion regulates the movement of the first mating protrusion in a direction;

when the connector is mated with the mating connector, the second receiving portion regulates the movement of the second mating protrusion in another direction; and each of the direction and the another direction is along the outer circumference of the holding member in a plane perpendicular to the first direction.

3. A connector assembly comprising the connector as recited in claim 1 and the mating connector.

4. The connector assembly as recited in claim 3, wherein the connector and the mating connector have shapes same as each other.

* * * * *